US008685191B2

(12) United States Patent
Liu et al.

(10) Patent No.: US 8,685,191 B2
(45) Date of Patent: Apr. 1, 2014

(54) TRANSFER METHOD USING THERMAL TRANSFER FILM

(75) Inventors: Chen-Hua Liu, Taipei (TW); Ru-Jen Chiu, Taipei (TW); Bar-Long Denq, Taipei (TW); Hung-Jen Chen, Taipei (TW)

(73) Assignee: Compal Electronics, Inc., Taipei (TW)

( * ) Notice: Subject to any disclaimer, the term of this patent is extended or adjusted under 35 U.S.C. 154(b) by 1442 days.

(21) Appl. No.: 12/025,783

(22) Filed: Feb. 5, 2008

(65) Prior Publication Data

US 2008/0277050 A1 Nov. 13, 2008

(30) Foreign Application Priority Data

May 10, 2007 (TW) ..... 96116603 A

(51) Int. Cl.
*B41M 5/00* (2006.01)
*B44C 1/165* (2006.01)
*B41M 3/12* (2006.01)

(52) U.S. Cl.
USPC ..... 156/230; 427/146

(58) Field of Classification Search
None
See application file for complete search history.

(56) References Cited

U.S. PATENT DOCUMENTS

2005/0167035 A1* 8/2005 Laskey et al. ..... 156/230
2005/0205200 A1* 9/2005 Flosbach et al. ..... 156/233

FOREIGN PATENT DOCUMENTS

TW 159119 6/1991

* cited by examiner

*Primary Examiner* — Philip Tucker
*Assistant Examiner* — Vicki Wu
(74) *Attorney, Agent, or Firm* — Jianq Chyun IP Office

(57) ABSTRACT

A thermal transfer film at least including a substrate, a semi-cured protection layer, and an ink layer is provided. The semi-cured protection layer is coated on the substrate, and a material of the semi-cured protection layer includes thermal curing resin and radiation curing resin. Moreover, the resin of the semi-cured protection layer is at least partially cured. The ink layer is coated on the semi-cured protection layer.

12 Claims, 11 Drawing Sheets

TRANSFER METHOD USING THERMAL TRANSFER FILM

CROSS-REFERENCE TO RELATED APPLICATION

This application claims the priority benefit of Taiwan application serial no. 96116603, filed on May 10, 2007. The entirety of the above-mentioned patent application is hereby incorporated by reference herein and made a part of this specification.

BACKGROUND OF THE INVENTION

1. Field of the Invention

The present invention generally relates to a thermal transfer technology, in particular, to a thermal transfer film, a method of manufacturing the same, and a transfer method.

2. Description of Related Art

Thermal transfer technology is a technology widely applied in goods required to have patterns and labels made thereon. Thermal transfer film is the most frequently used in the thermal transfer technology. However, the early thermal transfer film has poor hardness and abrasion resistance, so the later thermal transfer technology has a protection layer coated on the surface of an ink layer after transferring the ink onto an acceptor. Such a step increases the complexity of the process, and always results in decreased yield of the final product and increased cost.

FIG. 1 is a schematic view of a conventional thermal transfer film.

Referring to FIG. 1, a conventional thermal transfer film 10 includes a substrate 100, a release coating 102 coated on a transfer surface 108, an ink layer 104 coated on the release coating 102, and an adhesion layer 106 coated on the ink layer 104.

However, as the ink layer 104 of the thermal transfer film 10 in FIG. 1 is thermally transferred onto an acceptor, after peeling off the substrate, the ink layer will directly contact with the external, thus likely being damaged. Therefore, a thermal transfer film as shown in FIG. 2 is further developed.

Referring to FIG. 2, a thermal transfer film 20 is similar to that in FIG. 1 and includes a substrate 200, a release coating 202, and ink layer 204, with main differences that a thermosetting protection layer 210 is added between the release coating 202 and the ink layer 204, and the adhesion layer 106 is omitted, and at the same time, the thermosetting protection layer 210 protects the ink layer from being damaged by the external and serves as an adhesion layer.

A transfer method of the thermal transfer film 20 in FIG. 2 includes covering the thermal transfer film 20 on an acceptor; next, pressing and heating a back of the thermal transfer film, in which the thermosetting protection layer 210 gets into a molten state due to the pressure and heat, and a portion of the thermosetting protection layer 210 flows through the ink layer 204 to serve as an adhesion layer and is combined with the acceptor, while the other portion is still left on the ink layer 204 to serve as the protection layer; and final, peeling off the substrate 200, thereby transferring the ink layer 204 onto the acceptor.

However, the thermal transfer film 20 is merely applicable in the ink layer 204 having apertures or pores. And the thermosetting protection layer has poor mechanical properties and strength, as it has plasticity upon heating, thus the effect of protecting the ink layer is still limited.

In short, as for the conventional technology shown in FIG. 1, the product of the conventional thermal transfer film after thermal transferring has no protective functions. As for the conventional technology shown in FIG. 2, even having a protection layer, the protective function is deficient due to the poor hardness and abrasion resistance of the protection layer. After a period of use, the ink layer is stripped off or scratched on the surface, thus affecting the appearance and working life of the product.

Currently, for the product utilizing the thermal transfer technology available in the market, in order to compensate the deficient scratch resistance of the surface, a protection layer is spray-coated on the surface, which thus increases the process time, and results in decreased yield of the final product and increased cost, thereby being unbeneficial to the development of the thermal transfer technology.

SUMMARY OF THE INVENTION

Accordingly, the present invention is directed to a thermal transfer film having a semi-cured protection layer.

The present invention is directed to a transfer method, in which a full-curing process on a semi-cured protection layer is performed after transferring.

The present invention is directed to a method of manufacturing a thermal transfer film, which is capable of obtaining a product having high hardness, good abrasion resistance, and good chemical resistance.

The present invention provides a first type of thermal transfer film, at least including a substrate, a semi-cured protection layer coated on the substrate, and an ink layer coated on the semi-cured protection layer. A material of the semi-cured protection layer includes thermal curing resin and radiation curing resin.

The present invention provides a second type of thermal transfer film, including a substrate, a semi-cured protection layer, an ink layer, and an adhesion layer. The semi-cured protection layer is coated on the substrate, the ink layer is coated on the semi-cured protection layer, and the adhesion layer is coated on the ink layer. A material of the semi-cured protection layer includes thermal curing resin and radiation curing resin.

In an embodiment of the present invention, the material of the adhesion layer of the second type of thermal transfer film is one selected from among acrylic-based resin, urethane-based resin, vinyl-based resin, polyester-based resin, polystyrene-based resin, polypropylene-based resin, polyethylene-based resin, and polycarbonate-based resin, or any combination thereof.

In an embodiment of the present invention, a thickness of the semi-cured protection layer of the first type and the second type of thermal transfer films after drying ranges from 1 μm to 60 μm.

In an embodiment of the present invention, the thermal curing resin of the semi-cured protection layer of the first type and the second type of thermal transfer films is one selected from among acrylic-based resin, acrylic polyol based resin, vinyl-based resin, polyester-based resin, epoxy-based resin, and polyurethane-based resin, or any combination thereof.

In an embodiment of the present invention, the radiation curing resin of the semi-cured protection layer of the first type and the second type of thermal transfer films includes a monomer and an oligomer. The monomer is one selected from among monofunctional, bifunctional, or multifunctional methacrylate-based monomer, acrylate-based monomer, vinyl-based monomer, vinyl-ether based monomer, and epoxy-based monomer; and the oligomer is one selected from among unsaturated polyester-based oligomer, epoxy acrylate-based oligomer, polyurethane acrylate-based oligomer, polyester acrylate-based oligomer, polyether acrylate-based oligomer, acrylated acrylic-based resin, and epoxy-based resin.

In an embodiment of the present invention, the substrate of the first type and the second type of thermal transfer films is one selected from among resin film, metal film, or paper film.

In an embodiment of the present invention, a thickness of the substrate of the first type and the second type of thermal transfer films ranges from 4 μm to 800 μm.

In an embodiment of the present invention, the substrate of the first type and the second type of thermal transfer films can be a substrate having a surface with releasing effect.

In an embodiment of the present invention, the first type and the second type of thermal transfer films further include a release coating located between the substrate and the semi-cured protection layer.

The present invention further provides a transfer method. In the transfer method, the ink layer of the first type of thermal transfer film is attached on an acceptor, where the type of thermal transfer film includes a substrate, a semi-cured protection layer, and an ink layer. Next, the substrate is peeled off such that the semi-cured protection layer and the ink layer on the thermal transfer film are transferred onto the acceptor. Thereafter, a full-curing process is performed so as to fully cure the semi-cured protection layer on the thermal transfer film into a film having high hardness, good abrasion resistance, and good chemical resistance.

In an embodiment of the transfer method of the present invention, the step of attaching the first type of thermal transfer film on the acceptor includes coating an adhesive on the acceptor, and attaching the thermal transfer film on a surface of the acceptor with the adhesive, and then pressing and heating a back of the thermal transfer film.

The present invention further provides a transfer method. In the transfer method, the adhesion layer of the second type of thermal transfer film is adhered on an acceptor, where the second type of thermal transfer film includes a substrate, a semi-cured protection layer, an ink layer, and an adhesion layer. Next, the substrate is peeled off such that the semi-cured protection layer and the ink layer on the thermal transfer film are transferred onto the acceptor. Afterward, a full-curing process is performed so as to fully cure the semi-cured protection layer on the thermal transfer film into a film having high hardness, good abrasion resistance, and good chemical resistance.

In another embodiment of the transfer method of the present invention, the step of adhering the second type of thermal transfer film on the acceptor includes pressing and heating a back of the thermal transfer film.

The present invention further provides a method of manufacturing the first type of thermal transfer film. In the method, a liquid resin material is coated on a substrate, where the liquid resin material includes thermal curing resin and radiation curing resin. Next, the resin material is cured by heating or irradiation so as to partially cure the resin to convert the liquid resin material into a semi-cured protection layer in a semi-cured state, where the semi-curing state refers that the protection layer at least has no adhesion, so as to be beneficial to the subsequent coating of the ink layer. Thereafter, an ink layer is coated on the semi-cured protection layer.

The present invention further provides a method of manufacturing the second type of thermal transfer film. In the method, a liquid resin material is coated on a substrate, where the liquid resin material includes thermal curing resin and radiation curing resin. Next, the liquid resin material is cured by heating or irradiation so as to partially cure the resin to convert the liquid resin material into a semi-cured protection layer in a semi-cured state, where the semi-curing state refers that the protection layer at least has no adhesion, so as to be beneficial to the subsequent coating of the ink layer. Afterward, an ink layer is coated on the semi-cured protection layer, and an adhesion layer is then coated on the ink layer, where the adhesion layer is capable of the making the adhesion of the thermal transfer film and the acceptor better.

In all embodiments of the method of manufacturing the thermal transfer film of the present invention, before coating the liquid resin material, a release coating can be coated on the substrate, such that the substrate can be easily peeled off after transferring.

The present invention utilizes the thermal transfer film having a semi-cured protection layer, thus a full-curing process is required after transferring, and after full curing, a product having high hardness, good abrasion resistance, and good chemical resistance is obtained.

In order to make the features and advantages of the present invention more clear and understandable, the following embodiments are illustrated in detail with reference to the appended drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
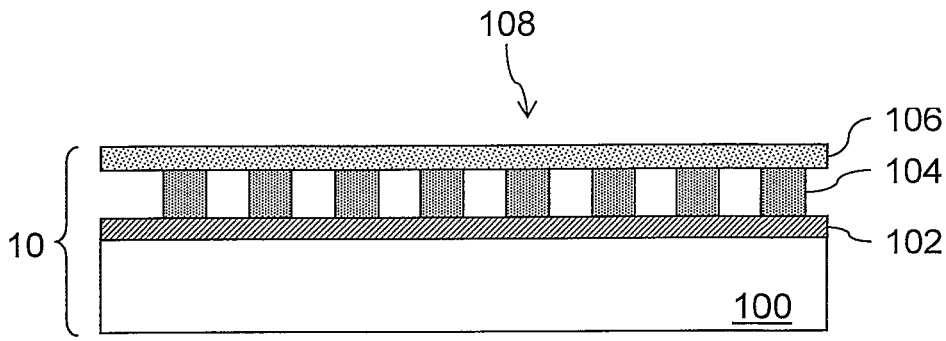
FIG. 1(PRIOR ART)
FIG. 1 is a schematic view of a conventional thermal transfer film.
Figure 2:
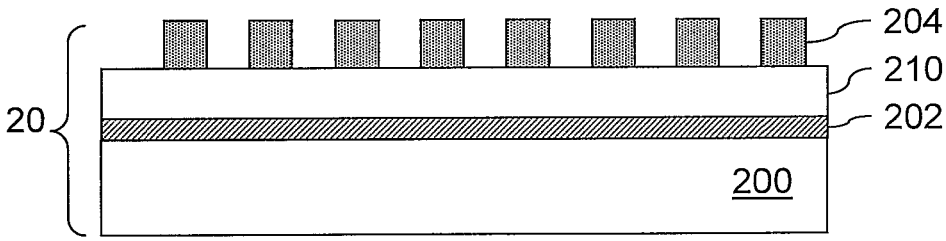
FIG. 2(PRIOR ART)
FIG. 2 is a schematic view of another conventional thermal transfer film.

Reference will now be made in detail to the present embodiments of the invention, examples of which are illustrated in the accompanying drawings. Wherever possible, the same reference numbers are used in the drawings and the description to refer to the same or like parts.

Hereinafter, the present invention is further illustrated with reference to accompanying drawings, and embodiments of the present invention are shown in the drawings. However, the present invention can be implemented in many different manners, and should not be limited to the embodiments of the present invention. In fact, the embodiments are provided to make the disclosure of the present invention more detailed and more integrated, and conveys the scope of the present invention to those of ordinary skill in the art fully. In the drawings, the sizes and relative sizes of layers and areas may be exaggerated for clarity.

It should be noted that, when an element or a layer is "on another element or layer", it can be directly on another element or layer, or connected to, or coupled to another element or layer, alternatively, an element or layer may exist therebetween.

Further, opposite directional terminology, such as "under," "on," and the like, used herein is used to illustrate the relationship between an element or feature and another (or a plurality of) element or feature in the figure(s) being described. It should be understood that, opposite directional terminology refers to the different orientation of the element being used or operated, other than the orientation described in the figure(s). For example, if the element in the figure(s) is turned over, the element originally described as "under" or "below" another layer is then positioned "on" or "above" another layer.

Figure 3:
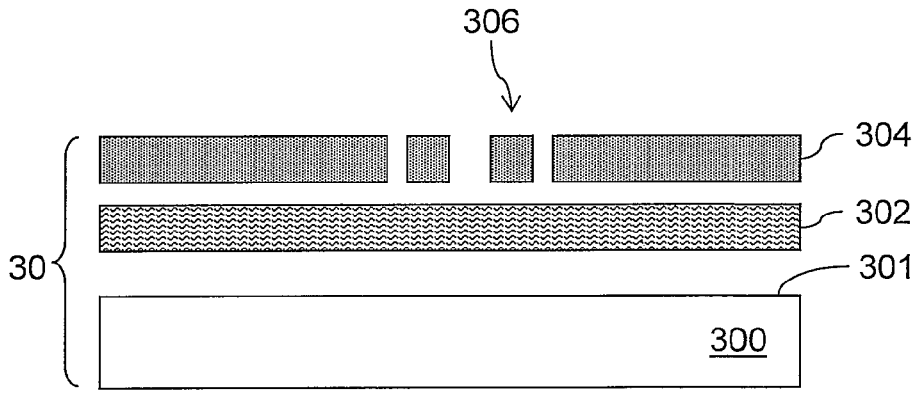
FIG. 3 is a schematic cross-sectional view of a thermal transfer film according to a first embodiment of the present invention.

FIG. 3 is a schematic cross-sectional view of a thermal transfer film according to a first embodiment of the present invention.

Referring to FIG. 3, a thermal transfer film 30 of the first embodiment is composed of a substrate 300, a semi-cured protection layer 302, and an ink layer 304. The semi-cured protection layer 302 is coated on a transfer surface 306 of the substrate 300. The semi-cured protection layer 302 is formed by first coating a hybrid liquid resin composed of thermal curing resin and radiation curing resin on the substrate and partially curing the resin in the protection layer through a heating or irradiation curing step to form a semi-cured state, and the semi-curing state refers that the protection layer at least has no adhesion, so as to be beneficial to the subsequent coating of the ink layer. The material of the semi-cured protection layer 302 includes thermal curing resin and radiation curing resin. The ink layer 304 is coated on the semi-cured protection layer 302. Further, according to the material of the semi-cured protection layer 302, a curing agent for thermosetting resin and a photoinitator for UV curing resin can be added therein.

According to the first embodiment, a thickness of the semi-cured protection layer 302 ranges from 1 μm to 60 μm, and preferably ranges from 5 μm to 25 μm. The thermal curing resin of the semi-cured protection layer 302 is one selected from among acrylic-based resin, acrylic polyol based resin, vinyl-based resin, polyester-based resin, epoxy-based resin, and polyurethane-based resin, or any combination thereof. The radiation curing resin of the semi-cured protection layer 302 includes a monomer and an oligomer. The monomer is one selected from among monofunctional, bifunctional, or multifunctional methacrylate-based monomer, acrylate-based monomer, vinyl-based monomer, vinyl-ether based monomer, and epoxy-based monomer; and the oligomer is one selected from among unsaturated polyester-based oligomer, epoxy acrylate-based oligomer, polyurethane acrylate-based oligomer, polyester acrylate-based oligomer, polyether acrylate-based oligomer, acrylated acrylic-based resin, and epoxy-based resin.

In the first embodiment, the substrate 300 can be a liquid resin film, such as acrylic-based resin, polyester-based resin, polystyrene-based resin, polypropylene-based resin, polyvinyl chloride-based resin, polyethylene-based resin, polycarbonate-based resin, and polyurethane-based resin. The substrate 300 can also be a metal film such as aluminum, copper, or a paper film such as cellulose. The thickness of the substrate 300 ranges from 4 μm to 800 μm, and more preferably ranges from 25 μm to 250 μm. Moreover, in the first embodiment, the substrate 300 can further be a substrate having a surface 301 with releasing effect.

Figure 4:
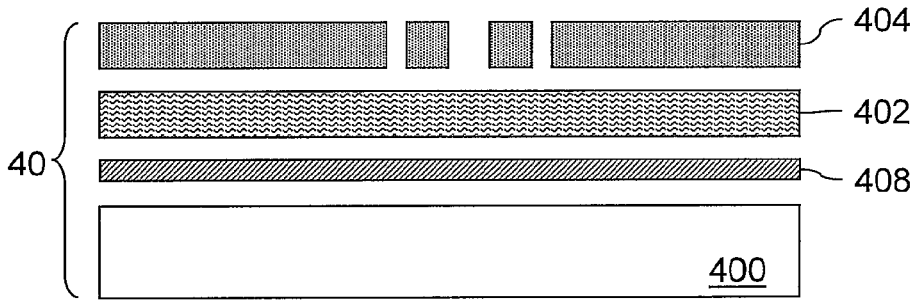
FIG. 4 is a schematic cross-sectional view of a thermal transfer film according to a second embodiment of the present invention.

FIG. 4 is a schematic cross-sectional view of a thermal transfer film according to a second embodiment of the present invention.

Referring to FIG. 4, a thermal transfer film 40 of the second embodiment is similar to the first embodiment and includes a substrate 400, a semi-cured protection layer 402 on the substrate 400, and an ink layer 404 on the semi-cured protection layer 402. The difference between the second embodiment and the first embodiment lies in that the second embodiment further has a release coating 408 located between the substrate 400 and the semi-cured protection layer 402, such that the substrate has better releasing effects. The conditions for other films can be obtained with reference to the first embodiment.

Figure 5:
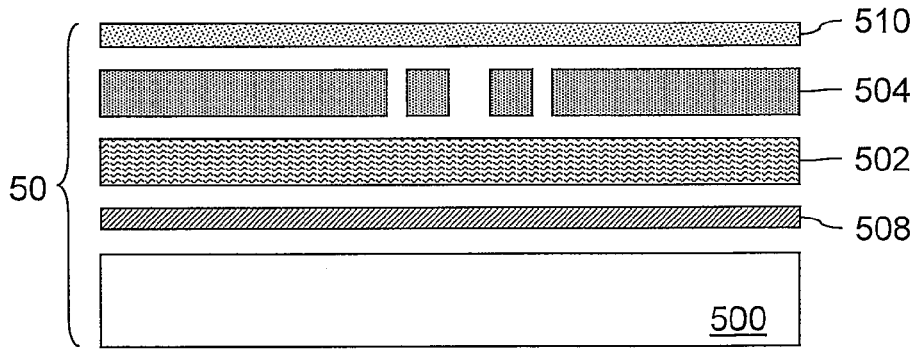
FIG. 5 is a schematic cross-sectional view of a thermal transfer film according to a third embodiment of the present invention.

FIG. 5 is a schematic cross-sectional view of a thermal transfer film according to a third embodiment of the present invention.

Referring to FIG. 5, a thermal transfer film 50 of the third embodiment is similar to the second embodiment and includes a substrate 500, a semi-cured protection layer 502 on the substrate 500, an ink layer 504 on the semi-cured protection layer 502, and a release coating 508 between the substrate 500 and the semi-cured protection layer 502. The difference between the second embodiment and the third embodiment lies in that the third embodiment further includes an adhesion layer 510 on the ink layer 504 to improve the adhesion of the thermal transfer film 50. In this embodiment, the material of the adhesion layer 510 is one selected from among acrylic-based resin, urethane-based resin, vinyl-based resin, polyester-based resin, polystyrene-based resin, polypropylene-based resin, polyethylene-based resin, and polycarbonate-based resin, or any combination thereof. The thickness of the adhesion layer 510 ranges, for example, from 1 μm to 15 μm, and preferably ranges from 3 μm to 6 μm. The thickness and material of the other films can be obtained with reference to the previous two embodiments. Further, if the substrate 500 is a substrate having a surface with releasing effect, the release coating 508 can be omitted.

Figure 6A:
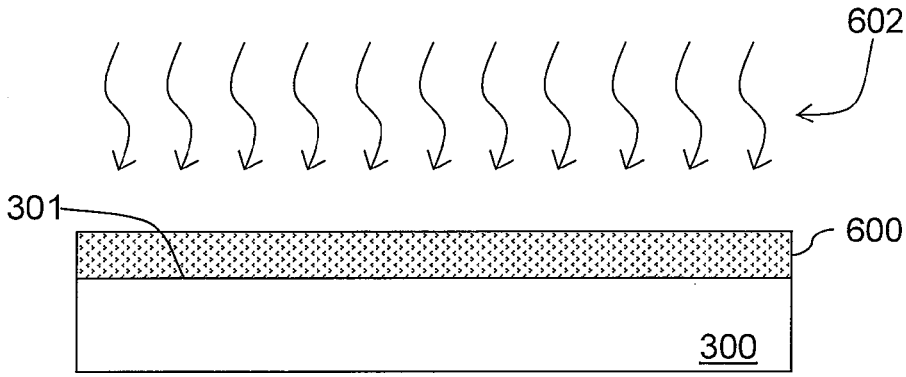
FIGS. 6A to 6B are schematic cross-sectional views of a manufacturing process of the thermal transfer film of the first embodiment.
Figure 6B:
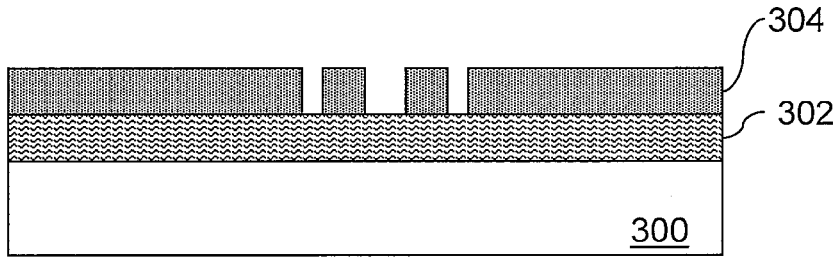

FIGS. 6A to 6B are schematic cross-sectional views of a manufacturing process of the thermal transfer film of the first embodiment, and the same reference numerals are used to refer to the same parts in FIG. 3.

Referring to FIG. 6A, a resin material 600 composed of thermal curing resin and radiation curing resin is coated on a substrate 300 having a surface 301 with releasing effect. Next, a thermal or irradiation curing process 602 is performed to partially cure the liquid resin material 600 in the figure, so as to convert it into a semi-cured state.

Next, referring to FIG. 6B, after the liquid resin material in FIG. 6A has been converted into a semi-cured protection layer 302, an ink layer 304 is coated on the semi-cured protection layer 302.

Figure 7A:
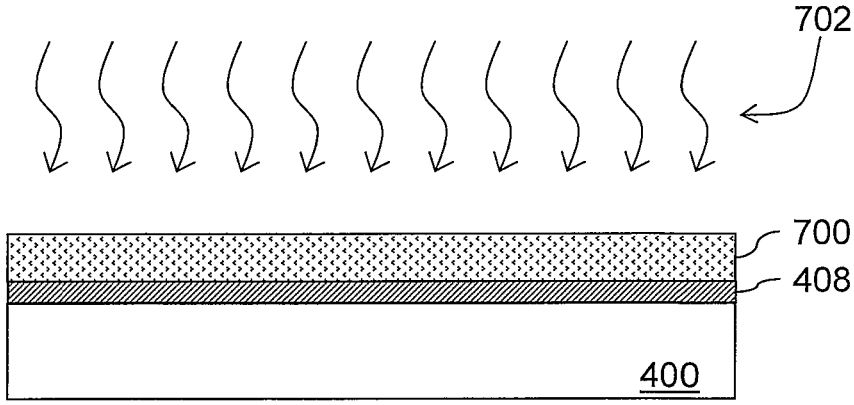
FIGS. 7A to 7B are schematic cross-sectional views of a manufacturing process of the thermal transfer film of the second embodiment.
Figure 7B:
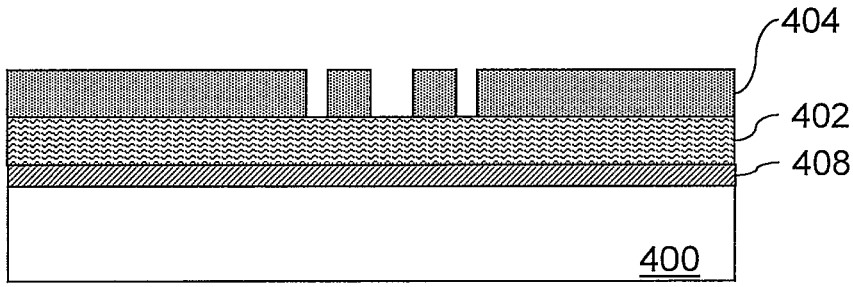

FIGS. 7A to 7B are schematic cross-sectional views of a manufacturing process of the thermal transfer film of the second embodiment, and the same reference numerals are used to refer to the same parts in FIG. 4.

Referring to FIG. 7A, first, a release coating 408 is coated on a substrate 400, and then a liquid resin material 700 including thermal curing resin and radiation curing resin is coated thereon. Next, a thermal or irradiation curing process 702 is performed to partially cure the liquid resin material 700 in the figure, so as to convert it into a semi-cured state.

Next, referring to FIG. 7B, after the liquid resin material in FIG. 7A has been converted into a semi-cured protection layer 402, an ink layer 404 is coated on the semi-cured protection layer 402.

Figure 8A:
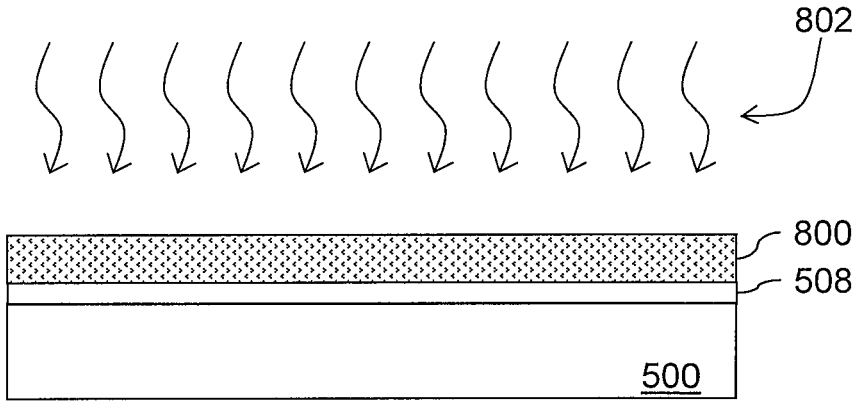
FIGS. 8A to 8C are schematic cross-sectional views of a manufacturing process of the thermal transfer film of the third embodiment.
Figure 8B:
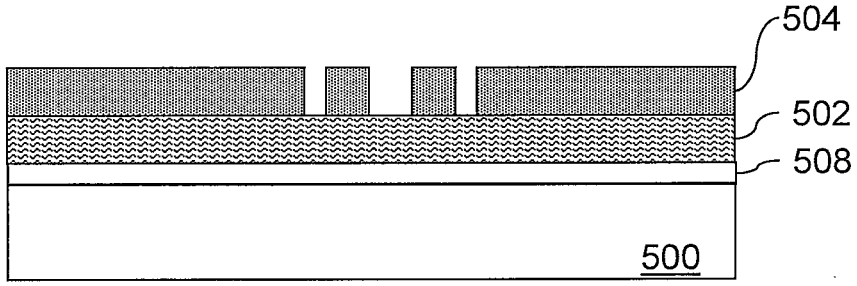
Figure 8C:
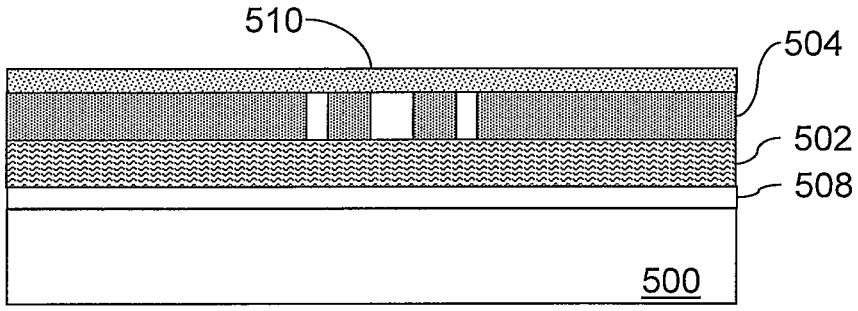

FIGS. 8A to 8C are schematic cross-sectional views of a manufacturing process of the thermal transfer film of the third embodiment, and the same reference numerals are used to refer to the same parts in FIG. 5.

Referring to FIG. 8A, first, a release coating 508 is coated on the substrate 500, and then a liquid resin material 800 including thermal curing resin and radiation curing resin is coated thereon. Next, a thermal or irradiation curing process 802 is perform to partially cure the liquid resin material 800, so as to convert it into a semi-cured state.

Thereafter, referring to FIG. 8B, after the liquid resin material in FIG. 8A has been concerted into a semi-cured protection layer 502, an ink layer 504 is coated on the semi-cured protection layer 502.

Finally, referring to FIG. 8C, an adhesion layer 510 is coated on the ink layer 504.

FIGS. 9A to 9E are schematic cross-sectional views of a transfer process of the thermal transfer film in FIG. 6B, and the same reference numerals are used to refer to the same parts in FIG. 6B.

Figure 9A:
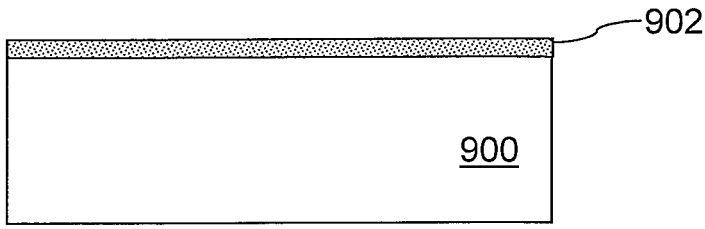
FIGS. 9A to 9E are schematic cross-sectional views of a transferring process of the thermal transfer film in FIG. 6B.

Referring to FIG. 9A, an adhesive 902 is coated on an acceptor 900.

Figure 9B:
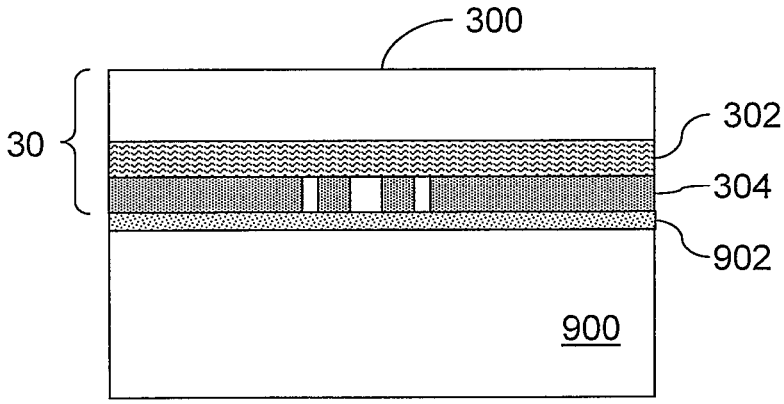

Next, referring to FIG. 9B, the thermal transfer film 30 including the substrate 300, the semi-cured protection layer 302 and the ink layer 304 is attached on a surface of the acceptor 900 having the adhesive 902, and then the back of the thermal transfer film 30 is heated or pressed, such that the thermal transfer film 30 is adhered on the acceptor 900. The purpose of heating is to soften the substrate, so as to be beneficial to the attachment of the substrate 300 and the acceptor 900, and at the same time, to melt the hot melt adhesive to have adhesion; and the purpose of pressing is to remove the bubbles and to improve the adhesion of the thermal transfer film 30 and the acceptor 900. The step of heating includes blowing hot air onto the thermal transfer film 30 or directly heating the thermal transfer film 30 by a hot presser (not shown); and the step of pressing includes directly pressing the thermal transfer film 30 by a presser, or vacuumizing under the acceptor 900 to make the thermal transfer film 30 and the acceptor 900 tightly adhered.

Figure 9C:
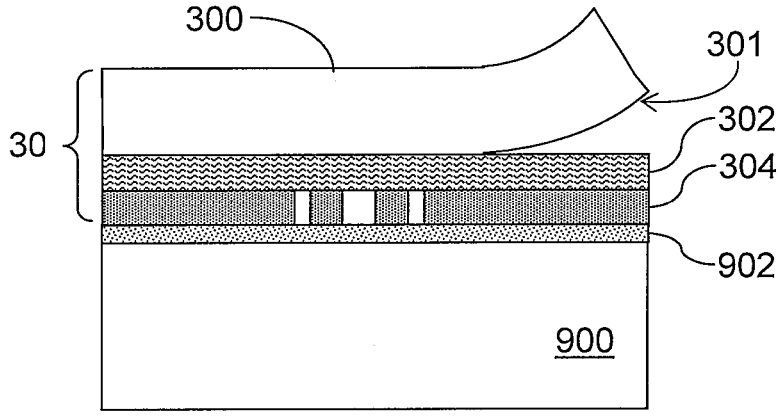

Thereafter, referring to FIG. 9C, the substrate 300 having the releasing surface 301 is peeled off, such that the semi-cured protection layer 302 and the ink layer 304 on the thermal transfer film 30 are transferred onto the acceptor 900. Definitely, if the substrate 300 does not has releasing effect itself, a release coating (refer to 408) can be added between the substrate and the semi-cured protection layer, as shown in FIG. 7B.

Figure 9D:
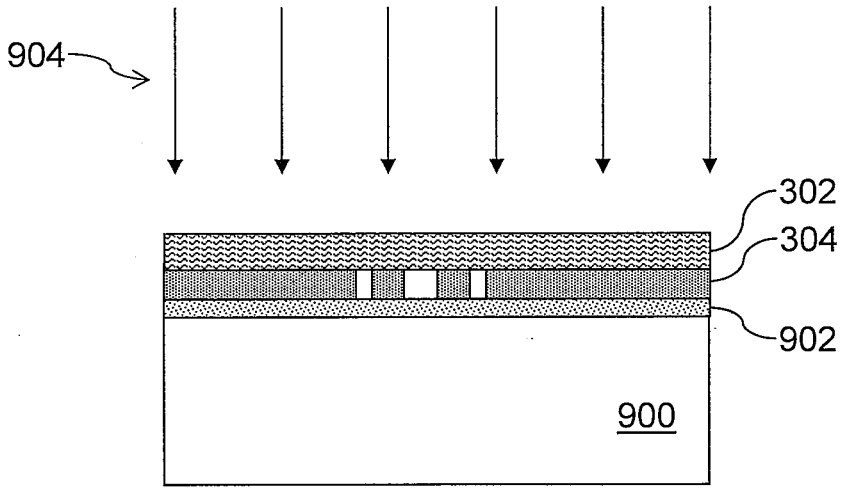

Then, referring to FIG. 9D, a thermal or irradiation curing process 904 is performed.

Figure 9E:
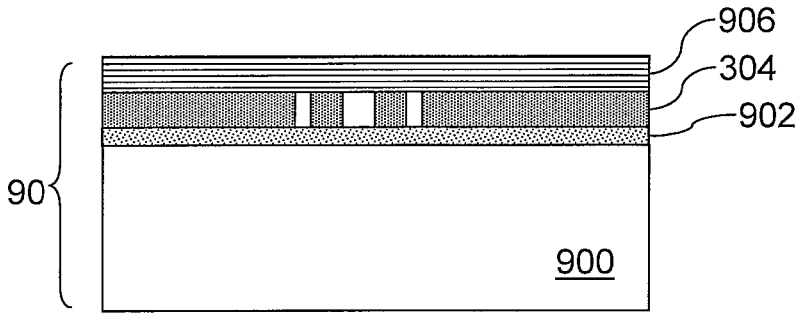

Afterwards, referring to FIG. 9E, after the semi-cured protection layer (e.g., 302 in FIG. 9D) is completely cured into a cured protection layer 906, a product 90 having high hardness, good abrasion resistance, and good chemical resistance is obtained.

FIGS. 10A to 10D are schematic cross-sectional view of a transferring process of the thermal transfer film in FIG. 8C, and the same reference numerals are used to refer to the same parts in FIG. 8C.

Figure 10A:
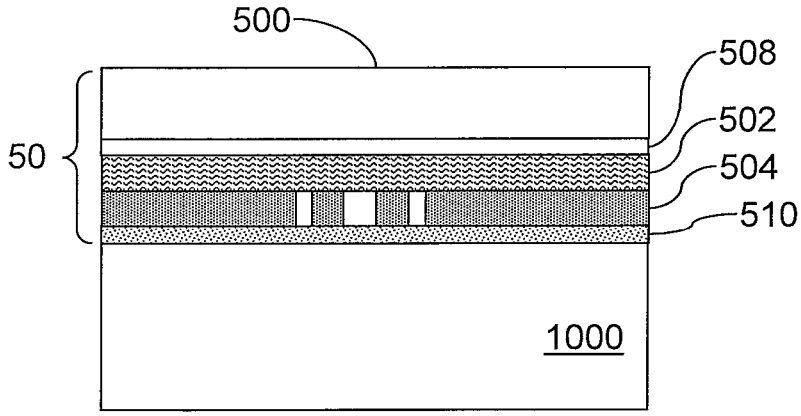
FIGS. 10A to 10D are schematic cross-sectional views of a transferring process of the thermal transfer film in FIG. 8C.

Referring to FIG. 10A, a thermal transfer film 50 including a substrate 500, a release coating 508, a semi-cured protection layer 502, an ink layer 504, and an adhesion layer 510 is adhered onto an acceptor 1000, and then a back of the thermal transfer film 50 is heated or pressed, so as to attach the adhesion layer 510 on the acceptor 1000.

Figure 10B:
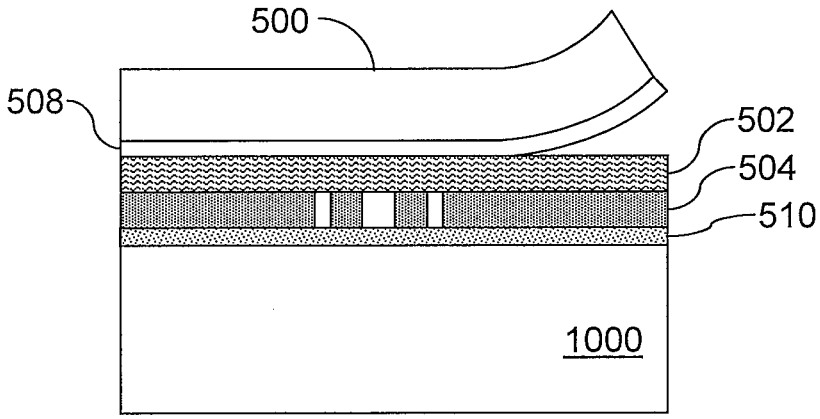

Next, referring to FIG. 10B, the substrate 500 is peeled off, and at this time, the release coating 508 is separated from the semi-cured protection layer 502, such that the semi-cured protection layer 502 and the ink layer 504 on the thermal transfer film 50 are transferred onto the acceptor 1000.

Figure 10C:
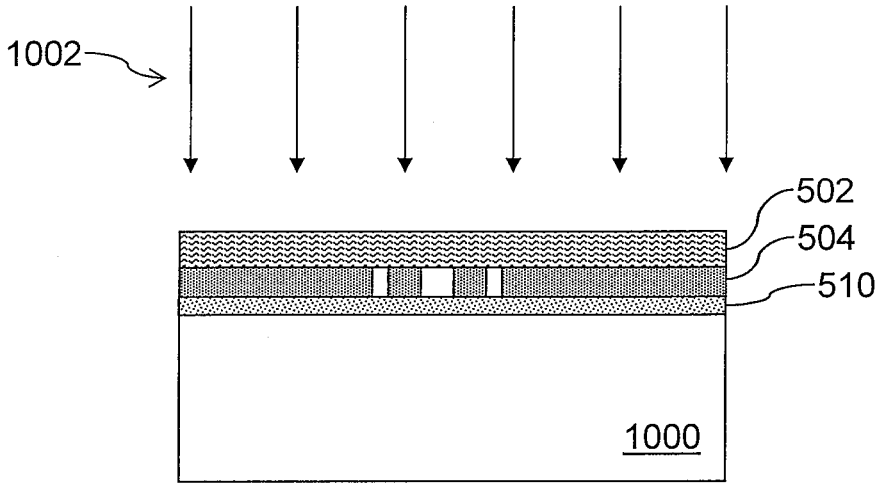

Thereafter, referring to FIG. 10C, a thermal or irradiation curing process 1002 is performed.

Figure 10D:
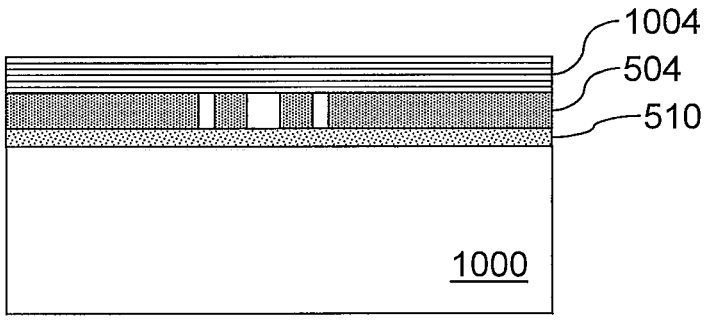

Finally, referring to FIG. 10D, after the step in FIG. 10C, a protection layer 1004 having high hardness, good abrasion resistance, and good chemical resistance is formed on the surface of the product.

In order to illustrate the method of manufacturing the thermal transfer film of the present invention and verify the effects of the thermal transfer film of the present invention in surface hardness, abrasion resistance, and chemical resistance, the following examples and test results are described for reference.

EXAMPLE 1

A substrate being a polyester-based resin film having a thickness of 50 μm was provided, and a thermosetting acrylic release resin was coated on the substrate as a release layer. A liquid resin layer formed by mixing thermal curing resin and radiation curing resin was coated on the release layer by blade coating. The composition of the liquid resin layer is 80-120 parts of thermal curing resin, 14-25 parts of 1,6-hexanediisocyanate trimer, 80-120 parts of irradiation curing resin, 3-5 parts of photoinitator, and 100-200 parts of ethyl acetate as a solvent. The liquid resin layer was heated and baked at 120° C. for 1 min, such that the surface was dry to touch, so as to get a semi-cured protection layer having a thickness of about 10 μm. An ink layer was printed on the semi-cured protection layer, and then an adhesion layer was coated on the ink layer, so as to form a thermal transfer film having a semi-cured protection layer.

The thermal transfer film was attached on a plastic piece, and the semi-cured protection layer and ink layer was transferred on the surface of the plastic piece by heating and pressing, and then the substrate was peeled off, so as to get a product. The surface of the product was irradiated by a UV-ray of 1000 mJ/cm$^2$, so as to completely cure the semi-cured protection layer.

EXAMPLE 2

The operation steps of Example 1 was repeated, so as to get the product, except that the composition of the liquid resin layer was changed to be 20-60 parts of thermal curing resin, 3-13 parts of 1,6-hexanediisocyanate trimer, 140-180 parts of irradiation curing resin, 4-8 parts of photoinitator, and 100-200 parts of ethyl acetate as a solvent.

The hardness, chemical resistance, and abrasion resistance of the surface of the products of Examples 1 and 2 was evaluated. The standard test modes are described herein below.

[Hardness Test]

A pencil hardness was tested by using a pencil hardness tester under a load of 500 g with a Mitsubishi pencil special for hardness test. The pencil was moved by an angle of 45° on the surface of a completely cured protection layer in the order from soft to hard according to the hardness order of the pencil from 9H to 6B. Observe the surface with naked eyes, test till the pencil tip does not make scratches on the surface, and then the final pencil hardness is determined.

[Chemical Resistance Test]

A gauze is immersed into ethanol, and then repeatedly scrubs on the surface of a completely cured protection layer for 400 times under a load of 500 g. Observe the surface conditions with naked eyes, and determine according to the following evaluation standards: ◎ represents no damage on the surface, ○ represents slight damage, Δ represents a little damage, and × represents a lot of damage.

[Abrasion Resistance Test]

The abrasion resistance test was performed by R.C.A test method with a load of 175 g by scrubbing the surface of the completely cured protection layer for 100 times. Observe the abrasion conditions of the surface with naked eyes, and evaluate according to the following evaluation standards: ◎ represents no abrasion on the surface, ○ represents slight abrasion, Δ represents a little abrasion, and × represents a lot of abrasion.

The test results are listed in Table 1. It can be seen that Examples 1 and 2 have excellent performance in surface hardness, abrasion resistance, and chemical resistance

TABLE 1

| | Surface hardness | Chemical resistance | Abrasion resistance |
|---|---|---|---|
| Example 1 | 2H | ◎ | ◎ |
| Example 2 | 2H | ◎ | ◎ |

In view of the above, the present invention utilizes a semi-cured protection layer composed of thermal curing resin and radiation curing resin to obtain a new thermal transfer film. When the thermal transfer film of the present invention is transferred, and then the semi-cured protection layer is completely cured, a product having high hardness, good abrasion resistance, and good chemical resistance is obtained.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A transfer method, comprising:

providing a thermal transfer film, comprising:

coating a liquid resin material on a substrate, wherein the liquid resin material comprises thermal curing resin and radiation curing resin;

partially curing the liquid resin material by heating to cure the thermal curing resin while the radiation curing resin is uncured, so as to convert the liquid resin material into a semi-cured protection layer; and coating an ink layer on the semi-cured protection layer to form the thermal transfer film;

attaching the thermal transfer film on an acceptor;

peeling off the substrate; and performing a full-curing process, so as to fully cure the semi-cured protection layer on the thermal transfer film into a film having high hardness, good abrasion resistance, and good chemical resistance.

2. The transfer method according to claim 1, wherein the step of attaching the thermal transfer film on the acceptor comprises:

coating an adhesive on the acceptor;

attaching the thermal transfer film on a surface of the acceptor with the adhesive; and pressing and heating a back of the thermal transfer film.

3. The transfer method according to claim 1, before coating the liquid resin material, further comprising coating a release coating on the substrate.

4. A transfer method, comprising:

providing a thermal transfer film, comprising:

coating a liquid resin material on a substrate, wherein the liquid resin material comprises thermal curing resin and radiation curing resin;

partially curing the liquid resin material by heating to cure the thermal curing resin while the radiation curing resin is uncured, so as to convert the liquid resin material into a semi-cured protection layer;

coating an ink layer on the semi-cured protection layer; and coating an adhesion layer on the ink layer to form the thermal transfer film;

adhering the thermal transfer film on an acceptor;

peeling off the substrate; and performing a full-curing process, so as to fully cure the semi-cured protection layer on the thermal transfer film into a film having high hardness, good abrasion resistance, and good chemical resistance.

5. The transfer method according to claim 4, wherein the step of adhering the thermal transfer film on the acceptor comprises pressing and heating a back of the thermal transfer film.

6. The transfer method according to claim 4, further comprising coating a release coating on the substrate before coating the liquid resin material.

7. A transfer method, comprising:

providing a thermal transfer film, comprising:

coating a liquid resin material on a substrate, wherein the liquid resin material comprises thermal curing resin and radiation curing resin;

partially curing the liquid resin material by irradiation to cure the radiation curing resin while the thermal curing resin is uncured, so as to convert the liquid resin material into a semi-cured protection layer; and coating an ink layer on the semi-cured protection layer to form the thermal transfer film;

attaching the thermal transfer film on an acceptor;

peeling off the substrate; and performing a full-curing process, so as to fully cure the semi-cured protection layer on the thermal transfer film into a film having high hardness, good abrasion resistance, and good chemical resistance.

8. The transfer method according to claim 7, wherein the step of attaching the thermal transfer film on the acceptor comprises:

coating an adhesive on the acceptor;

attaching the thermal transfer film on a surface of the acceptor with the adhesive; and pressing and heating a back of the thermal transfer film.

9. The transfer method according to claim 7, before coating the liquid resin material, further comprising coating a release coating on the substrate.

10. A transfer method, comprising:

providing a thermal transfer film, comprising:

coating a liquid resin material on a substrate, wherein the liquid resin material comprises thermal curing resin and radiation curing resin;

partially curing the liquid resin material by irradiation to cure the radiation curing resin while the thermal curing resin is uncured, so as to convert the liquid resin material into a semi-cured protection layer;

coating an ink layer on the semi-cured protection layer; and coating an adhesion layer on the ink layer to form the thermal transfer film;

adhering the thermal transfer film on an acceptor;

peeling off the substrate; and performing a full-curing process, so as to fully cure the semi-cured protection layer on the thermal transfer film into a film having high hardness, good abrasion resistance, and good chemical resistance.

11. The transfer method according to claim 10, wherein the step of adhering the thermal transfer film on the acceptor comprises pressing and heating a back of the thermal transfer film.

12. The transfer method according to claim 10, further comprising coating a release coating on the substrate before coating the liquid resin material.

* * * * *